US005257059A

United States Patent [19]

Ramos

[11] Patent Number: 5,257,059

[45] Date of Patent: Oct. 26, 1993

[54] DEVELOPING PROCESSOR

[76] Inventor: Gregorio Ramos, 13 Plaza Simón Bolivar, 01003-Vitoria, Spain

[21] Appl. No.: 857,155

[22] Filed: Mar. 25, 1992

[30] Foreign Application Priority Data

Mar. 26, 1991 [ES] Spain ..... 9100780

[51] Int. Cl.[5] ..... G03D 3/08

[52] U.S. Cl. ..... 354/322; 354/331; 354/336

[58] Field of Search ..... 354/312, 313, 320-323, 354/331, 336, 337, 339, 307, 310, 311; 134/64 P, 122 P

[56] References Cited

U.S. PATENT DOCUMENTS

| | | | |
|---|---|---|---|
| 4,001,856 | 1/1977 | Stimson | 354/331 |
| 4,311,380 | 1/1982 | Cutter | 354/322 |
| 4,486,085 | 12/1984 | Boie et al. | 354/312 |
| 4,740,074 | 4/1988 | Powell | 354/337 |

*Primary Examiner*—D. Rutledge
*Attorney, Agent, or Firm*—Browdy and Neimark

[57] ABSTRACT

The processor is equipped with a helicoidal spiral tub (2). A special telescopic arm (24) mounted on the central shaft of the tub allows the material to be developed to pass through the tanks that make up the tub. The arm is L-shaped and the material to be developed that passes from one tank to the other is placed on the other wing (26) or section. A series of material holders by way of flexible parts (31, 31*a*) with grooves or recesses are mounted on this wing, with these parts opposite each other and the grooves receiving the material to be developed, either on plates or on films. The tanks are connected to units which heat, fill, control and drain them. The cabinet that encloses the processor has a hinged box (52) that occupies the intake for the machine and is provided with an inlet with a sheath provided with access for the operator's hands.

12 Claims, 4 Drawing Sheets

DEVELOPING PROCESSOR

BACKGROUND OF THE INVENTION

The invention deals with processors for developing photographic material equipped with a helicoodal spiral tub made up of independent tanks for liquids by having its central shaft arranged in a horizontal position inside a covering casing. A holder for the material to be developed, which is joined to an arm connected to a central shaft, has access to these tanks. A kind of processor of this type is known through the patent ES. P.8702521.

SUMMARY OF THE INVENTION

In this patent, the temperature of each of the baths contained in the tanks is controlled by a series of external and internal water tanks, which keep the temperature even, for instance, between 24 and 40 degrees. Each one of the baths is independent and each tank is occupied by the corresponding developing liquid and is communicated with the exterior through the tank filling and draining pipe.

The fact of having the water tanks arranged so as to control the temperature means a practical complication for the processor, both from the point of view of construction and from its capacity for perfectly controlling the temperature of the baths.

The objective of this invention is to make available a processor of the helicoidal spiral type, in which the tanks for material to be developed are operated from independent control units, which make sure that the capacity of the baths is maintained as well as keeping the temperature of the tanks perfect continuously.

Another object of the invention consists of creating a special carrying arm mounted on the central shaft of the processor, which allows the material to be developed to pass from one tank to the other with total ease.

A third object of the invention consists of a material holder device with special characteristics, which is capable of transfering the material on plates or in the form of films, with sufficient loading capacity.

A fourth and final object of the invention consists of taking advantage of the cover or casing of the processor to proceed with handling the material inside the processor without losing the characteristic of maintaining the appropriate darkness in its interior.

To put these objectives into practice, a helicoidal spiral tub with its central shaft arranged in a horizontal direction is used. The rear side of the tub is closed whereas the front face is open starting from some semicircular walls which allow the independent tanks to be arranged. Each one of these tanks contains a developing bath and they are communicated with the exterior by means of rear pipes that pass through the control units.

The centre of the tub receives a drive shaft that passes through the upper edges of the front semicircular walls, which also have semicircular hollows for this purpose and through which the said shaft runs. This shaft goes through the front section of the tub and is made up of two parallel metallic rods symmetrically arranged with regard to the theoretical axis of the tub. Both rods receive one of the arms of the holder or carrier which is made up of an L-shaped part, the other arm of which travels through the tanks in the tub.

The holder is designed to travel along the two rods of the shaft, so that the arm that carries the material to be developed can pass from one chamber to another with the said material. At the same time, the said holder is provided with extension capacity, in order to be able to adapt itself to the distance from the tub centre shaft to each one of the tanks of developing liquid.

The arm of the holder that is connected to the two rods of the centre shaft is made up of a longitudinal plate with a rectangular cross-section and provided with a slot which is also longitudinal. To connect the material holder to the centre shaft, specifically to the two centre shaft rods, a connection element is placed on the two sides of the longitudinal plate and inside the slot.

The connection element is composed of two discs placed in a parallel situation and between which the previously mentioned longitudinal plate becomes housed. The discs remain separated due to spacer shafts, for example three, of which two have bearings incorporated into them, with these bearings being housed inside the slot in the plate. The bearings and logically the shafts on which they are mounted, are arranged diametrically separated and horizontally aligned, in such a way that they travel along the slot.

The discs are also provided with horizontal slots, four in each of them, in which small shafts are housed, with these shafts in turn having bearings incorporated. The bearings, four in each disc, are applied on the sides of the material holder plate above the slot, in order to make the rolling of the connection element easier.

The rear disc of the two that the connection element is composed of, is in turn connected with a cylindrical projection that juts out towards the two centre shaft rods. The cylindrical projection is provided with two parallel perforations which hold bearings inside them. These perforations receive the two rods from the centre shaft and, because of the bearings that are incorporated into them, make turning and transfer of this cylindrical projection on the rods easier, when the rods turn, driven by the motor of the processor.

Therefore, transfer of the connection element is made possible along the rods from the centre shaft, on which it can rotate, in such a way that the assembly also allows the slotted arm to be extended with the greatest of ease.

The other arm of the holder is responsible for travelling through the tanks in the tub carrying the material to be developed, and is made up of a flattened body fitted with a lid of an equal cross-section. The body is provided with a series of pistons and the lid has holes that received these pistons, with the material to be developed being held between them. Some of the holes in the lid have roundheaded nuts, which go through the holes in the lid by means of screw-threaded necks, in such a way that the lid can be fastened to the pistons in the body by means of the said nuts, with the material to be developed being held between them.

Fitted onto the holder is an element which includes the material that has to be developed. This element is, precisely, the material holder and it is made up of two strips of articulated flexible material, arranged in a parallel fashion, between which is situated a flexible plate, for example made of plastic, which gives the assembly a certain rigidity.

The side strip are formed by bands of strip made up of a series of single parts, made of rubber for example, in such a way that these units are connected to the next ones by means of a set of strips of the same material. Each group of strips is connected to another identical one thanks to corresponding recesses and projections cut at the ends of their outer edges.

The ends of the strips are occupied by closure parts which make it easier for the material to be developed to enter and are connected to the other strips by means of recesses and projections that correspond with others at the end of the strip where they are placed.

Each unit of the parts of the strip is symmetrical in relation to the opposite one situated at the other side of the flexible intermediate plate, and are provided with longitudinal recesses in their opposite faces. There are usually five of these recesses, with the central one being closed at its ends and receives, as will be seen later, some projections from the central flexible plate. The other four are open at both sides, so as to hold the plates or films to be developed.

To make it easier for the material to be developed to pass through the recesses, one of the ends of each one is to be found with a wide open entrance that acts like a funnel for the material to be received. These funnel-shaped areas are placed alternately on the four recesses for the purpose of making it easier to load the material to be developed.

The end parts that close the strips are in their turn provided with the central recess and another four open ended ones, with funnel shaped areas at the outer ends of two of them and at the inner ends of the other two. In these end parts, the outer funnel shaped ends are very wide in order to help the initial entry of the material to be developed.

The central flexible part is provided with longitudinal sides in which semicircular cut-outs have been made, regularly distributed, which form teeth between each two of them. These teeth are housed in the central recesses of the single parts of the strips, in such a way that they form the material holder unit with them.

If the flexible plate is of a certain width, the material holder holds photographic paper of a certain dimension, which fits into the recesses in the single parts of the side strips.

By placing narrow flexible plates, the material holder is adapted to receive rolls of film, which can occupy the recesses of single parts of the strips and wind themselves round the material holder. In this case, the roll is inserted through the end parts, starting its entry through one of their funnel shaped recesses so as to pass through the aligned recesses of the single parts of the strips, starting from their funnel shaped areas. At the outlet, at the opposite end, the roll is inserted through one of the funnel shaped recesses of the other end parts and it returns to pass through another line of recesses, which have their funnel shaped entrances arranged in the opposite direction.

A roll of film can be arranged in its rolled-up form on the material holder in such a way that, due to the manner it fits into the recesses, sufficient space is established around the film to allow the developing liquids to circulate.

Each tank with developing material is in contact, by means of tubular pipes, with a chamber, inside of which there is a heating element and a temperature probe which controls so that each bath is to be found in the appropriate conditions. In the same way, in the said chamber, there is a volumetric probe connected to each developing tank, with which the amount of liquid in each tub is controlled.

The chamber connected with each tub is also provided with holes in which pumps are connected for filling and draining the tanks, so that the baths can be properly controlled.

This assembly is operated by means of a programme, according to which the filling, homogenizing and draining of the tanks are carried out automatically.

The cabinet in which the processor is placed has a hinged cover at its front upper end. This cover or lid is shaped like a drawer, with an open front top, which on being turned against the front of the processor, occupies its intake. The opposite end of the cover or lid is occupied by a flexible sheet of a cloth type or similar, which is equipped with sleeves that allow the operator to insert his hands to handle items inside the processor.

BRIEF DESCRIPTION OF THE DRAWINGS

All the details mentioned and others can be seen more clearly on the sheets of drawings that accompany this report.

DETAILED DESCRIPTION OF A PREFERRED EMBODIMENT

Figure 1:
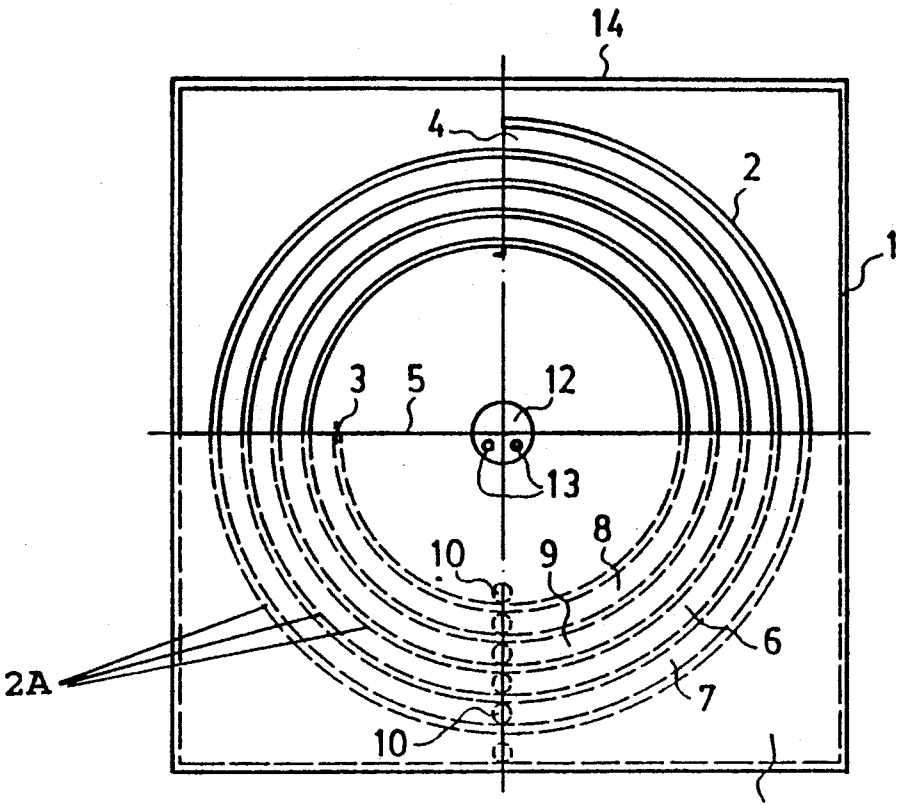
FIG. 1 represents a front view of the processor.

In accordance with FIG. 1, we can see the outer cabinet or casing (1) of the processor with the helicoidal spiral body (2), with its entry (3) and exit (4) for the material to be developed. The body (2) is open in its upper half and closed up to a height (5) in its lower half (11). Developing tanks (6), (7), (8) and (9) are situated inside each tub, with these tanks being occupied by the corresponding developing liquids up to a height near line (5).

In the centre of the tub is the centre shaft (12), driven by a programmed motor, with the two rods (13) responsible for receiving the holder and the element that moves the said holder. The upper part (14) of the processor receives a cover or lid similar to a drawer, which is not shown in this figure. Each tank is equipped with holes (10) so that they can be filled and drained.

Figure 2:
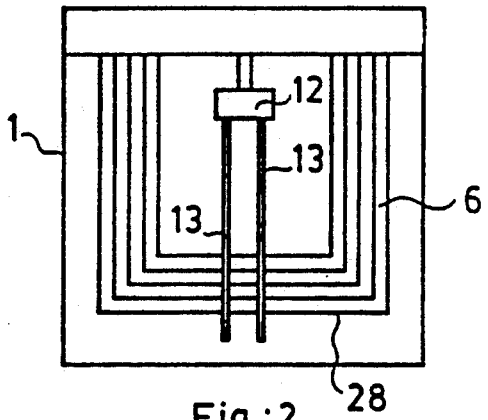
FIG. 2 shows a top view of FIG. 1.

In FIG. 2 we would like to point out the situation of the chambers, with an intermediate one (6) between them, and the way in which the shaft (12) juts out from the rear part of the machine. The front section of the helicoidal spiral tub is closed by front walls (28) which make each one of them independent from the rest. These walls (28) reach approximately half-way up the tub, and their upper edges have semicircular hollows to allow the rods (13) to pass through.

Figure 3:
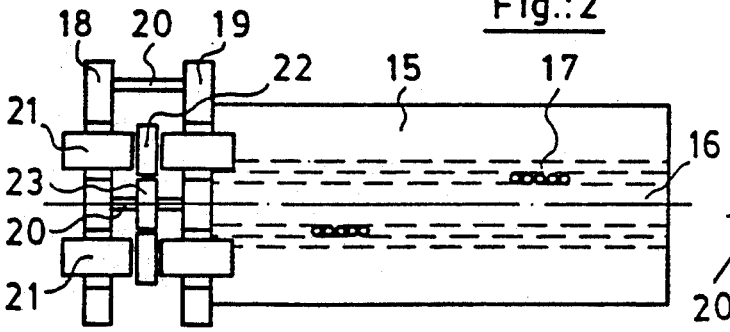
FIG. 3 deals with the element which is connected to the two rods of the centre shaft to operate the holder arm.
Figure 4:
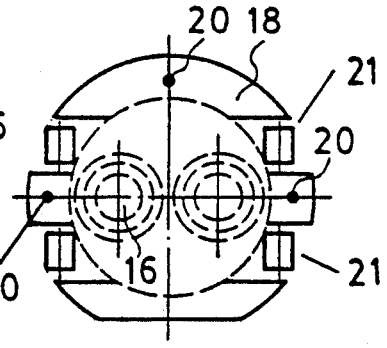
FIG. 4 is a left-side view of FIG. 3.

In FIGS. 3 and 4 we can see the element that is connected to the rods (13) and serves as a foundation and a guide for the holder. It is made up of a cylindrical section (15) with two longitudinal perforations (16) passing through it, with bearings being arranged inside these perforations, to allow the said section (15) to rotate and to travel along the rods (13).

In front of this cylindrical area we can appreciate the discs (18) and (19), arranged parallel to each other at a certain distance and separated by three spacer shafts (20). Of these three shafts (20), the two lower ones are diametrically separated and each receive bearings (23).

The discs are provided with four openings in each of them, in which bearings (21) are also arranged, fitted to vertical shafts that pass through the openings.

Figure 5:
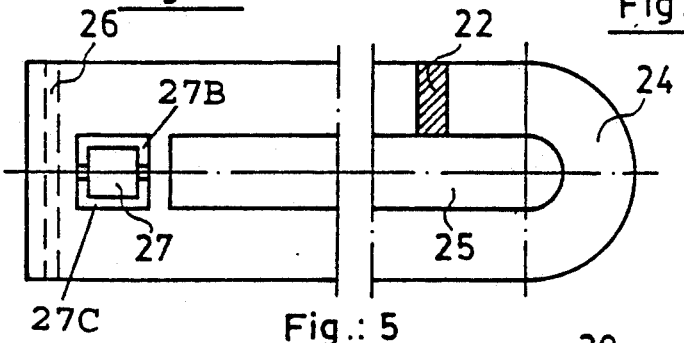
FIG. 5 corresponds to a front view of the holder arm.

The arm (24) of the holder shown in FIG. 5 is taken in between the bearings (23) and (21), in such a way that the bearings (23) are housed in the central slot (25) and the bearings (21) act against the walls of the section (22), as illustrated in FIG. 3.

FIG. 5 represents the arm (24) of the holder, which is L-shaped, with its other arm (26). The longitudinal slot (25) that receives the bearings (23) can be observed and with the upper and lower sections (22) on which the bearings (21) roll. The arm (24) is therefore perfectly controlled in its movements in relation to turning or rotating in either a vertical or a horizontal plane.

During operation, the arm (24) is turned by the rods (13) of the processor centre shaft and the arm (26) travels with the material holder through the tanks (6), (7), (8) and (9). The arm (24) begins to extend as the arm (26) occupies the tank (8) and turns towards the tanks (9), (6) and (7). . . in order to pass the material through the developing baths.

On the other hand, and depending on the specific shape of the tub as the material passes from one of the tanks to another, there are liable to be certain movements in the direction of the centre shaft, which are perfectly overcome and controlled by the bearings (17) of the element (15).

Precisely during these movements, the arm (24) becomes confronted by its end near the arm (26) with the front edges (2A) of the helicoidal spiral body. To make it easier for the holder to turn, the loose cylinder (27) is placed, mounted on a window cut (27C) in the arm (24), in such a way that this cylinder turns on shaft (27B) over the said edges (2A).

Figure 6:
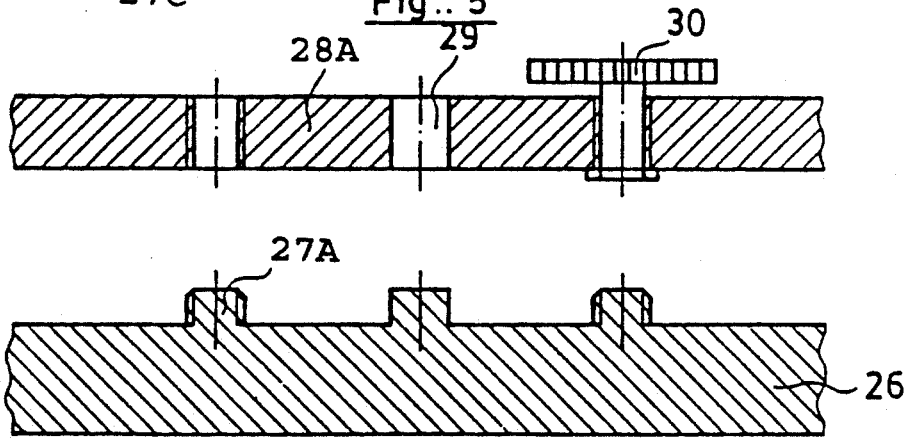
FIG. 6 represents the wing of the holder arm that includes the material holder.

For its part, the arm (26) of the holder which is represented in diagrammatic form in FIG. 6, shows a base section on which a series of projections or protrusions (27A) stand out, and another section in the form of a lid or cover (28*a*) provided with holes (29) through which the above-mentioned protrusions pass. Also arranged on this lid (28*a*) are a series of round headed nuts (30), which, with their necks threaded and fastened to the said lid, can be screwed onto the said protrusions (27A). The material to be developed is situated between both, the arm (26) and the lid (28*a*).

Figure 7:
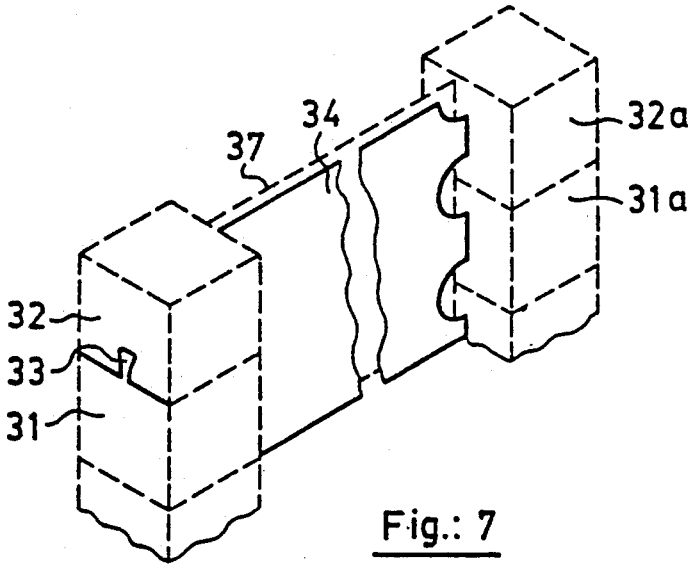
FIG. 7 is a diagrammatic perspective of the material holder.

The material holder that includes the photographic papers or rolls of film appears in a diagrammatic perspective in FIG. 7. This material holder is made up of a series of single or unitary parts (31) and (31*a*), which are symmetrical with relation to a central plane and are made up of flexible strips. The ends of these strips are finished by other parts (32) and (32*a*), which are connected to the said strips by means of an outer dovetail (33) joint.

Figure 8:
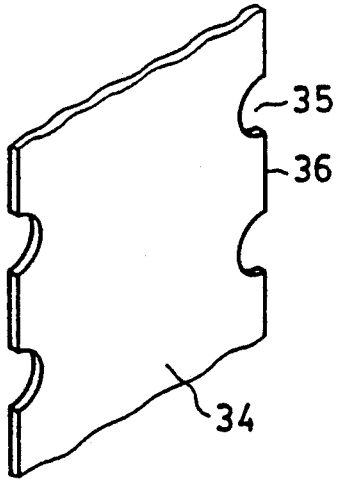
FIG. 8 is a perspective of the flexible central plate of the material holder.

Between the said flexible side strips, a flexible plate (34), FIGS. 7 and 8, is situated, which gives body to the assembly to receive the photographic paper or roll (37) that is being dealt with.

Figure 9:
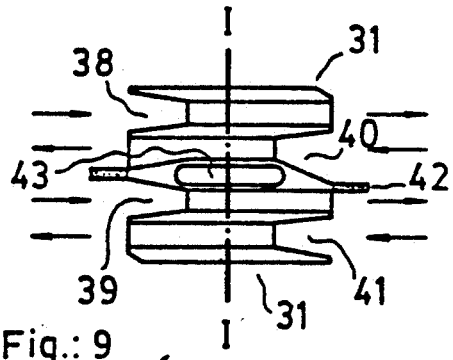
FIG. 9 is an elevation of each single stretch or band of the flexible strip of the material holder.
Figure 10:
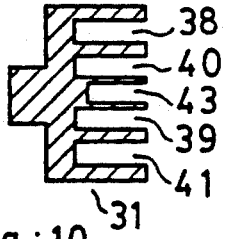
FIG. 10 corresponds to the cross-section I—I shown in FIG. 8.

The flexible side strips are made up of parts (31) like the one illustrated in FIGS. 9 and 10. In these figures we can observe the existence of some recesses (38), (40), (41) and (39), which alternately have wide funnel. shaped mouths or entrances towards one side or other of the part. In the centre, it is possible to observe the recess (43) in which the projections or protrusions (36) of the flexible plate (34), FIG. 8, are housed.

Each part (31) is connected to an adjoining part (31) by means of ribs (42), until groups are formed of several units identical to each other, which, thanks precisely to the ribs mentioned, conserve their flexibility. Each group of parts (31) is connected to other groups by means of a connection identical to the one indicated by (33) in FIG. 7.

The parts (31*a*) opposite parts (31) are symmetrical with relation to a central plane of the plate (34), in such a way that from one end of the assembly which is so formed, a paper or a roll of film can be made to house in and along one row of recesses, for example (38), in accordance with the directions indicated in FIG. 9.

Figure 11:
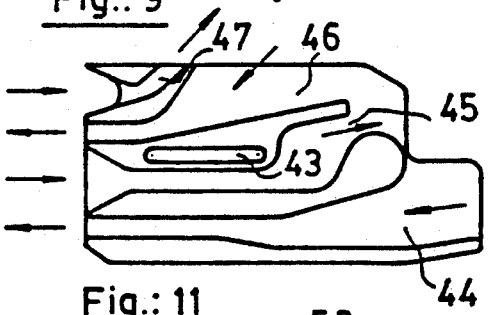
FIG. 11 represents an elevation of an entry part for film on the material holder.
Figure 12:
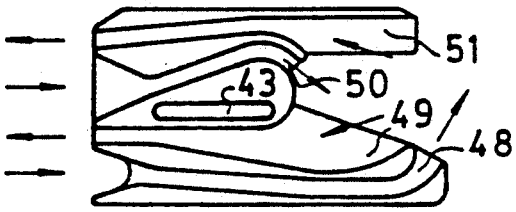
FIG. 12 represents an elevation of an exit part for film on the material holder.

The formal characteristics of the end parts (32) and (32*a*), in FIG. 7, are defined in FIGS. 11 and 12. The part which appears in FIG. 11 would be the one that finishes off the parts shown in FIGS. 9 and 10, with two wide entry or intake areas (44) and (46), another two exit or outlet areas (45) and (47), and with the recess (43) for the flexible central plate. This part is foreseen as the initial entry or intake part, with another symmetrical part corresponding to this at the other side of the flexible plate (34).

The part shown in FIG. 12 corresponds to another part situated at the other end of a strip and another symmetrical part will correspond with it in relation to the flexible central plate.

Once that the flexible strips with the unitary or single parts (31) and (31*a*) have been assembled, together with the end parts (32) and (32*a*) and the flexible plate (34), the assembly is ready to receive either photographic paper, by placing a plate of the appropriate dimensions, or roll or film by varying the width of the plate (34). In both cases, the teeth-like protrusions (36) of the plate will remain housed in the central recesses (43) of the parts.

When wishing to place a roll of film on the material holder in order for it to be developed, it is first inserted into the entry or intake recess (44) in the end part shown in FIG. 11, passing then to the recess (41) in the part (31), in the direction indicated by the arrows. This front or forward part of the roll will continue housing itself in the different parts (31) through their recesses (41), which for this purpose have their wider funnel-shaped entry or intake areas towards the same side, until it reaches the end parts (FIG. 12), into which it inserts itself to then leave through position (48).

Once that the front part of the roll has reached the exit (48) of the part shown in FIG. 12, it re-inserts itself through the entry or intake (49) in the same part and passes through the recesses (39) in the parts (31), until it leaves through the recess (45) in the part shown in FIG. 11. From this exit (45) it returns to house itself in the recess (46) and in the recesses (40) of the parts (31), to then leave from (50) in FIG. 12, re-enter through (51) in the same part and pass through the recesses (38) in the part (31), until it finally arrives at the recess (47) in the end part shown in FIG. 11.

In this way, a specific material holder can gather in a length of film four times greater than its true length, with the particularity that thanks to the special characteristics of the whole assembly, sufficient space is secured between each turn of the roll of film to ensure perfect passage of the developing liquids.

In the case of photographic paper, the fact that a specific material holder might include up to four different sheets to be developed has not been discarded either.

Obviously, the number of recesses in the material holder can be varied at will to assume a greater or smaller number of them, according to requirements.

Figure 13:
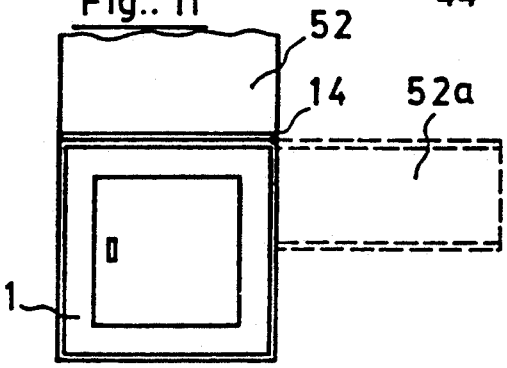
FIG. 13 is a side view of the processor.
Figure 14:
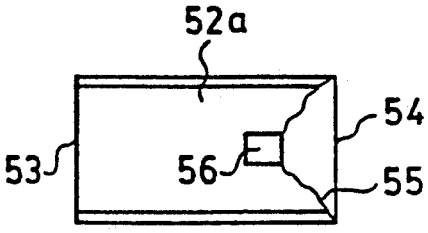
FIG. 14 represents the cover (lid) of the processor.

As regards FIGS. 13 and 14, we can observe the outer body or casing (1) of the processor and above it the drawer-lid (52), articulated at its front forward area. This drawer-lid can be made to turn or pivot on its hinged area (14) so that it adopts the position (52*a*), thus closing the hollow or gap in the upper front part of the processing chamber. This drawer-lid (52) is provided with an open end (53) through which the said hollow or gap is occupied, and another end (54) opposite to the previous one, occupied by a sheath (55) equipped with some inlets or sleeves (56) through which the operator can manipulate in the interior of the processor.

Figure 15:
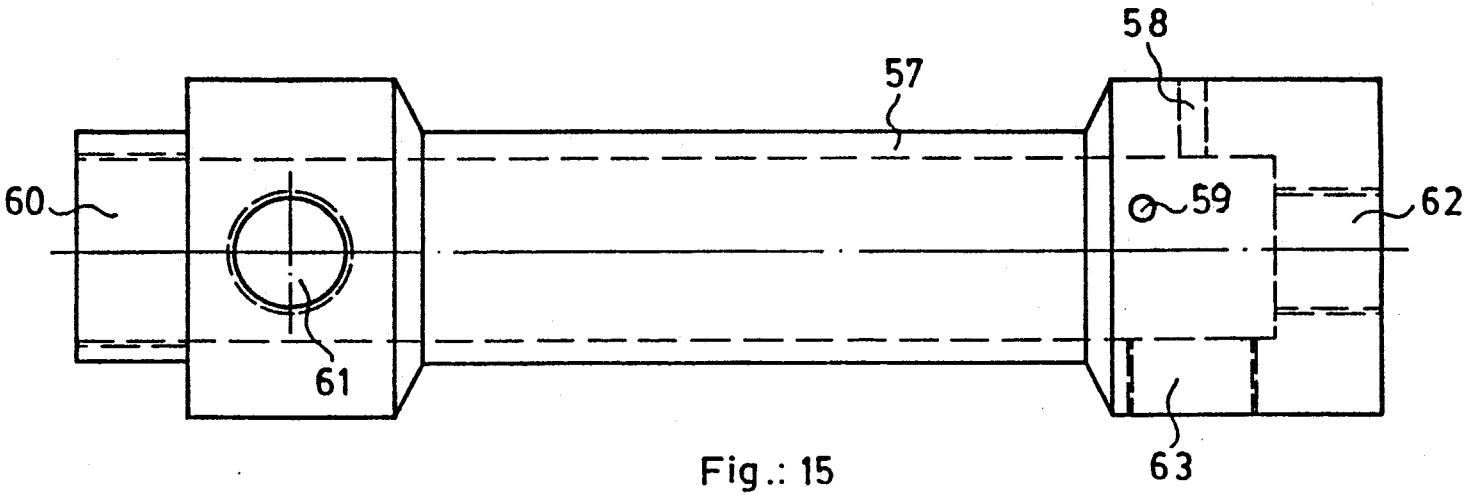
FIG. 15 represents a view of the control chamber for each tank.

As regards the volume and temperature control unit for the tanks of developing liquid for each tub, and in accordance with FIG. 15, the unit (57) is provided, and is reached by the inlet and outlet pipes (62) and (63) for the liquid that come from each tub, as well as another that communicates with the exterior (61). This unit is occupied by an electrical heating element at (60) and has one intake (58) for a temperature probe and another intake (59) for a volumetric probe. These probes are connected to a programming unit which keeps both variables according to what is planned.

I claim:

1. A developing processor comprising;

a helicoidal spiral body (2) forming a plurality of tubs therein, an outer casing (1) having walls housing said helicoidal spiral body, said plurality of tubs being arranged coaxially around a rotatable shaft (12) and spaced along a longitudinal length from said walls of said outer casing (1), a rear end of said casing closing a first end of said helicoidal spiral body and said plurality of tubs, and having a front end extending upward a certain distance and height, a second end of said helicoidal spiral body having a front edge (2A) extending laterally therefrom around each of said plurality of tubs, a second end of said each of said plurality of tubs being closed up from said front edge to said certain distance and height of said front end of said casing by respective parallel front walls (28) to form concentric independent chambers (6, 7, 8, 9) for developing liquids in said plurality of tubs, a space above said front end of said casing permitting access to a center of said plurality of tubs, two rods (13) extending past said parallel front walls, from a free end of said rotatable shaft (12), said two rods being symmetrically spaced from a longitudinal axis of said plurality of tubs, holding and carrying arm means slideably engaged on said two rods for holding material to be developed and consecutively moving said material through each of said chambers when said shaft (12) is rotated and said holding and carrying arm means is engaged between said front edge and a front wall of said parallel front walls, material holder means for material (34, 37) to be developed, secured to said holding and carrying arm means, temperature, filling and draining control means located in said chambers for controlling a temperature and volume of developing liquids, and cover or lid (52) means hinged on said casing for closing an interior of said developing processor from an exterior while providing access to work and handle material or elements in said developing processor.

2. The developing processor according to claim 1, wherein said two rods (13) are situated above semicircular spaces formed in said parallel front walls (28).

3. The developing processor according to claim 1, wherein said holding and carrying arm means comprises:

a first arm (24), and a second arm (26) connected in an L-shaped configuration, said first arm slideably and rotatably engaged to said two rods to permit said second arm together with material to be developed to be moved consecutively through said chambers.

4. The developing processor according to claim 3, wherein said holding and carrying means further comprises;

a cylindrical housing (15) having two bores (16) with bearings (17) therein engaged to said two rods (13) to permit said cylindrical housing to move along the length of said two rods, interlinking means on said first arm (24) and said cylindrical housing (15) for sliding said first arm on said cylindrical housing when said cylindrical housing is rotated on said shaft (12).

5. The developing processor according to claim 4, wherein said interlinking means comprises;

two discs (18, 19) arranged in parallel, a first disc of said two discs engaged to said cylindrical housing, a second disc of said two discs engaged to said first disc by a plurality of shafts (20), two shafts of said plurality of shafts being diametrically opposed and carrying bearings engaged in a slot of said first arm, each of said two discs having two pairs of slots on an exterior surface, and bearings secured on shafts in each of said two pairs of slots in sliding engagement with said first arm.

6. The developing processor in accordance with claim 3, wherein said second arm (26) has a plurality of screw-threaded projections and a cover with first holes corresponding to said projections, said cover being secured on said projections by discs threaded to said projections, wherein, an end of said material holder means has second holes corresponding to said projections, wherein, said material holder means is secured to said second arm by arranging said second holes on said projections and thereafter threading said discs on said projections to secure said cover to said second arm.

7. The developing processor in accordance with claim 1 wherein said material holder comprises;

two articulated strips (31, 31*a*) of plastic material, between which is placed a flexible plate (34) to connect the two strips, in that the strips are formed by unitary or single sections joined together, which in their opposite faces have horizontal recesses (38) to receive the material to be developed and the flexible plate, as well as end parts for the strips that make it easier for the material to enter the material holder.

8. The developing processor in accordance with claim 7, wherein each unitary or single section and each end part of said two articulated strips is symmetrical with the opposite one in relation to a central plane of the material holder and the parts are provided with five recesses, two upper ones and two lower ones for the material to be developed and one central one for the flexible plate, in that the four recesses for material alternately have longitudinal inlets with wide entry mouths and narrow outlets or exits, and inlets with narrow mouths and wide exits.

9. The developing processor according to claim 8, wherein the unitary or single parts are carried out in strips of several units connected to each other by means of longitudinal ribs (42) and connected to other strips and to the ends by the corresponding recesses and projections that fit together with these ribs.

10. The developing processor according claim 7, wherein the flexible plate (34) is provided with semicircular hollows cut in its longitudinal sides, with the spaces or teeth between those hollows being housed in the central recesses of the unitary or single parts and of the end parts.

11. The developing processor according to claim 1 wherein said control means comprises:

a series of tubes, each connected, by means of tubular pipes, to each independent chamber of said chambers, inside of said each chamber is placed an electrical heating element (60) to maintain the temperature of the liquids, one probe (58) to measure the temperature and another probe (59) to measure the volume of liquid in said each chamber, and pumps for filling and draining.

12. The developing processor according to claim 1, wherein said cover or lid means (52) is hinged to an upper front part of said casing, which on turning becomes situated over said space, with one side open to said space and the opposite side occupied by a sheath (55) provided with inlets or sleeves for the operator's hands towards the interior of said casing wherein said lid or cover prevents light from entering the developing processor.

* * * * *